US012234074B2

(12) United States Patent
Cheng et al.

(10) Patent No.: US 12,234,074 B2
(45) Date of Patent: Feb. 25, 2025

(54) FLEXIBLE PACKAGE FOR ARTICLES

(71) Applicant: The Procter & Gamble Company, Cincinnati, OH (US)

(72) Inventors: Zhan Cheng, Beijing (CN); Lei Zhou, Beijing (CN); Dongpo Huang, Beijing (CN)

(73) Assignee: The Procter & Gamble Company, Cincinnati, OH (US)

( * ) Notice: Subject to any disclaimer, the term of this patent is extended or adjusted under 35 U.S.C. 154(b) by 118 days.

(21) Appl. No.: 17/842,911

(22) Filed: Jun. 17, 2022

(65) Prior Publication Data

US 2022/0402674 A1 Dec. 22, 2022

(30) Foreign Application Priority Data

Jun. 18, 2021 (WO) ..... PCT/CN2021/100952

(51) Int. Cl.

| | |
|---|---|
| ***B65D 75/58*** | (2006.01) |
| ***B65D 75/12*** | (2006.01) |
| ***B65D 75/26*** | (2006.01) |
| ***B65D 75/56*** | (2006.01) |

(52) U.S. Cl.

CPC ..... *B65D 75/5827* (2013.01); *B65D 75/12* (2013.01); *B65D 75/26* (2013.01); *B65D 75/566* (2013.01)

(58) Field of Classification Search

CPC .... B65D 75/5827; B65D 75/12; B65D 75/26; B65D 75/566

USPC ..... 383/25

See application file for complete search history.

(56) References Cited

U.S. PATENT DOCUMENTS

| | | | | |
|---|---|---|---|---|
| 3,098,601 | A * | 7/1963 | Anderson | B65D 75/66 383/205 |
| 3,175,752 | A * | 3/1965 | Stabenow | B65D 75/5838 229/203 |
| 2005/0094903 | A1* | 5/2005 | Nyambi | B65D 75/5805 383/116 |
| 2011/0111158 | A1* | 5/2011 | Myers | B65D 75/5833 229/87.05 |

(Continued)

FOREIGN PATENT DOCUMENTS

| | | | |
|---|---|---|---|
| EP | 1057742 | A1 | 12/2000 |
| EP | 2017192 | A1 | 1/2009 |
| WO | 2015038880 | A2 | 3/2015 |

OTHER PUBLICATIONS

PCT Search Report and Written Opinion for PCT/CN2021/100952 Dec. 14, 2021,14 pages.

*Primary Examiner* — Jes F Pascua

(74) *Attorney, Agent, or Firm* — Anna E. Haller; Amanda Herman Berghauer

(57) ABSTRACT

The present invention relates to a package of one or more articles, the package comprising a substrate comprising at least one film layer wherein the substrate forms a plurality of panels and an opening feature, wherein the panels define an interior compartment, and wherein the one or more articles are disposed in the interior compartment, wherein the substrate has a first tearing force in a first direction and a second tearing force in a second direction, the second direction being perpendicular to the first direction, wherein the first tearing force is no greater than about 240 gf as measured according to Tearing Force Test, and wherein a ratio of the second tearing force to the first taring force is no less than about 1.35.

19 Claims, 11 Drawing Sheets

(56) References Cited

U.S. PATENT DOCUMENTS

| | | | | |
|---|---|---|---|---|
| 2013/0156900 | A1* | 6/2013 | Ranganathan | B65D 75/002 426/123 |
| 2017/0105889 | A1 | 4/2017 | Nishimura et al. | |
| 2019/0337672 | A1* | 11/2019 | McGee | B65D 17/402 |
| 2020/0031550 | A1* | 1/2020 | Douglas | B65D 75/5827 |
| 2020/0069119 | A1* | 3/2020 | Yoshida | A47K 10/421 |

* cited by examiner

FLEXIBLE PACKAGE FOR ARTICLES

CROSS REFERENCE TO RELATED APPLICATIONS

This application claims priority to Chinese PCT Patent Application No. PCT/CN2021/100952, filed on Jun. 18, 2021, which is herein incorporated by reference.

FIELD OF THE INVENTION

The present invention relates to flexible packages for articles which is easy for a consumer to open.

BACKGROUND OF THE INVENTION

Non-fragile consumer products such as hygiene products and cosmetic products are often packaged in a flexible package, such as a package made of film.

One unmet need in flexible package made of film is that it is not easy to open. Many flexible packages are often not easy to control the propagation of the tearing even with assistance with an opening feature, and leave the opened packages with unpleasant appearance or even tear apart the packages completely. Prior opening features such as various configurations of opening perforations have not provided easy facilitation of opening, and in addition or alternatively, tend to promote substantial destruction of the package during opening, rendering it unsatisfactory for use as a storage container.

After opening a package of disposable absorbent articles and removing one or more items needed for immediate use, a consumer may wish to leave the remaining unused supply of product in the package for storage until the next time additional items are needed. In addition, it is often desirable particularly in environments where high humidity and substantial quantities of airborne dust and dirt particles may be present that the package has a recloseability capability that allows the package to be reclosed to an extent suitable to help protect the unused product from airborne contaminants. Moreover, it is desirable that the package retains, to some extent, its shape with a neat appearance, and structural integrity to remain useful as a container for storing unused product following opening.

To date, flexible packages with an opening feature have generally been less than fully satisfactory.

It is an object of the present invention to provide an easy open flexible package which can be easily and reliably opened along a predetermined direction in the package.

It is another object of the present invention to provide a flexible package which can be easily opened with linear, smooth and controlled tearing.

It is still another object of the present invention to provide a flexible package to open easily which can be recloseable.

SUMMARY OF THE INVENTION

The present invention provides a package of one or more articles, the package comprising a substrate comprising at least one film layer, wherein the substrate has a first tearing force in a first direction and a second tearing force in a second direction, the second direction being perpendicular to the first direction, wherein the first tearing force is no greater than about 240 gf as measured according to Tearing Force Test, and wherein a ratio of the second tearing force to the first taring force is no less than about 1.35. The substrate forming a plurality of panels and an opening feature. The panels define an interior compartment, and the one or more articles are disposed in the interior compartment.

For ease of discussion, the invention disclosed herein will be discussed with reference to the numerals referred to in figures. The figures and detailed description should however not be considered limiting the scope of the claims, unless explicitly indicated otherwise, and the invention disclosed herein is suitable to package a wide variety of product.

DETAILED DESCRIPTION OF THE INVENTION

Figure 1A:
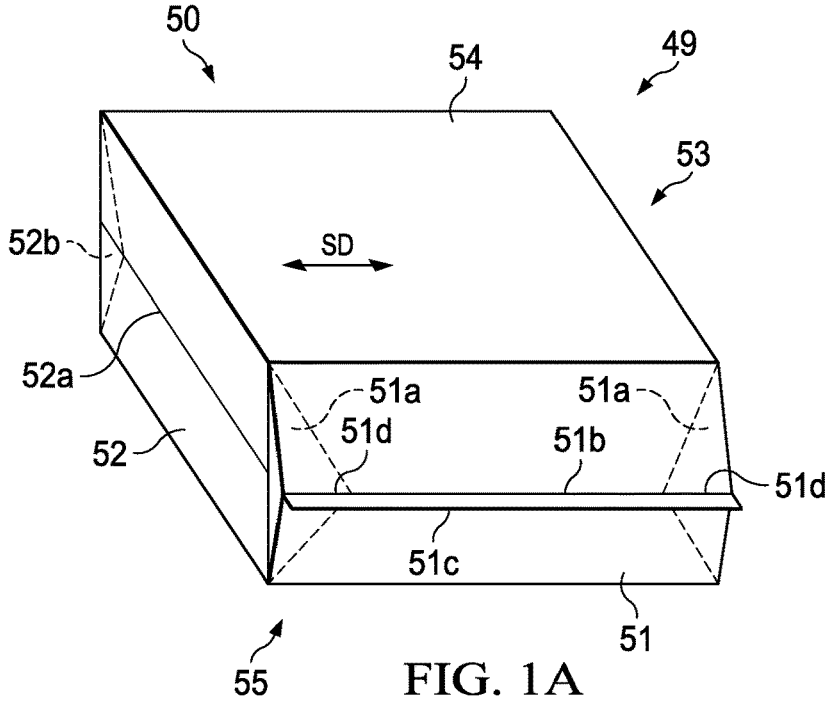
FIG. 1A is a perspective view of a flexible package.

All ranges are inclusive and combinable. The number of significant digits conveys neither limitations on the indicated amounts nor on the accuracy of the measurements. All numerical amounts are understood to be modified by the word "about" unless otherwise specifically indicated.

"Absorbent article" as used herein refers to products that absorb and contain body exudates, and, more specifically, refers to devices that are placed against or in proximity to the body of the wearer to absorb and contain the various exudates discharged from the body. Absorbent articles may include diapers (baby diapers and diapers for adult incontinence), pants (for babies or for adults), absorbent inserts (which are intended to be inserted into an outer cover to form a diaper or pant), feminine care absorbent articles such as sanitary napkins, pantiliners, or tampons, and the like. As used herein, the term "exudates" includes, but is not limited to, urine, blood, vaginal discharges, sweat and fecal matter.

"Cosmetic products" as used herein include locations, creams, tonics, cosmetic oils, facial masks, facial wipes and the like.

"Film" means a sheet structure having a length, width and thickness (caliper), wherein each of the length and width greatly exceed the thickness, i.e., by a factor of 1,000 or more, the structure having one layer (monolayer) or more respectively adjacent layers (multilayer), each layer being a substantially continuous structure formed of one or more thermoplastic polymer resins (including blends thereof).

"Hygiene products" as used herein refers to products for personal hygienic care, including disposable articles and cleansing products. Typical disposable hygiene products include disposable absorbent articles such as infant diapers, sanitary napkins, panty liners, breast pads, tampons and the like, and cleansing products such as washes, soaps, shampoos, hair conditioners, detergents and the like.

"Package" as used herein refers to a material provided to surround or enclose products such as hygiene products or cosmetic products.

"Machine direction" as used herein refers to the direction of the film production line. "Cross-machine direction" as used herein refers to a direction, which extends perpendicularly to said machine direction.

"Sealed" as used herein refers to a package having an interior that is inaccessible until the package is ruptured.

"Weakness line" as used herein refers to areas in which the package material has a reduced tear resistance compared to regions outside the weakness line. The weakness line can be provided by continuous lines or by a line of weakness points. The weakness line includes perforations, scoring, or a crease line.

Substrates

The substrate to form the package according to the present invention has a first tearing force in a first direction and a second tearing force in a second direction, the second direction being perpendicular to the first direction. The first tearing force is no greater than about 240 gf, or no greater than 210 gf, or no greater than 150 gf, as measured according to Tearing Force Test. When the first tearing force is too high such as greater than about 240 gf, it may require consumers to take more efforts to tear open the package, and thus it is deemed to be not easy opening packages. The first tearing force may be no less than about 20 gf as measured according to Tearing Force Test. When the first tearing force is too low, the package may be too easy to be open or torn and it poses problems in maintaining the integrity of the package before the time of opening, for example, packaging process and/or transportation or storage of packaged products. A ratio of the second tearing force to the first taring force is no less than about 1.35, or no less than about 1.4, or no less than about 1.5. When the ratio of the second tearing force to the first taring force is lower than about 1.35, it may be difficult to control the tearing propagation along the desired direction due to a small tearing force difference between the first and second directions.

In the substrate, the second tearing force may be no less than about 60 gf, or no less than about 100 gf, or no less than about 150 gf. It may be essential for the second tearing force to be sufficiently high to make sure the tear propagation is along the first direction. If the second tearing force is lower than 60 gf, it may be difficult to control the tearing propagation along the desired first direction.

The reduction of the tear force can be achieved by any suitable means known in the art, such as reducing the thickness or strength of the package material by e.g., cutting, punching, mechanical or ultrasonic embossing or by changing the crystalline structure of the package material by e.g., applying heat, a laser beam, high voltage or adding high crystallized material such as HDPE or the like.

The first direction may be a machine direction or a cross-machine direction. The first direction may be a direction forming an acute angle with the machine direction.

A substrate to form the package of the present invention comprises a polymeric film layer.

A polymeric film layer forming or comprised by the substrate according to the present invention may be formed of one or more polyolefins, such as polyethylene (PE) and polypropylene (PP). Polymeric films may also include blown or cast film materials in a blend of low density polyethylene (LDPE), linear low density polyethylene (LLDPE), metallocene PE blends (metPE), ethylene vinyl acetate, Surlyn®, polyethylene terephthalate (PET), mono and biaxially oriented polypropylene (M/BoPP) and nylon.

The film layer may be a single layer (monolayer), or may be formed by at least two layers (multilayer). A multilayer film may have, for example, an outer skin layer formed of a first polymer and an inner skin layer formed of a second polymer. (As used herein, the terms "outer" and "inner" refer to the positioning of the layer relative the inside and the outside of the finished package; thus, the "inner layer" faces the contained product, and the "outer layer" faces outward and has an outer surface that is exposed to view and touch by, e.g., shoppers in a retail store.)

A multilayer film may be co-formed (such as by coextrusion), or in another example, individual layers may be separately formed and then laminated together following their formation, by use of a suitable laminating adhesive. In this latter example, an advantage provided is that one of the layers may be printed on one side before lamination. Following that, the printed side may be faced inward (facing the other layer(s)) during lamination, such that it is protected by the other layer(s) from abrasion and wear in the finished film product, thereby preserving the integrity of the printed images, graphics, verbal content, etc. A suitable multilayer film may be formed of one or more polyolefins, such as polypropylene and polyethylene. In one example, the film may have at least two layers, including a first layer of predominately polyethylene and second layer of predominately polypropylene. In one example, a layer formed of predominately polyethylene having a first relatively higher melting temperature, and a layer of predominately polyethylene having a second relatively lower melting temperature, may be used to form the outer and inner layers, respectively. In another example, an inner layer may be formed predominately of a first type of polyethylene having a relatively lower melting temperature, and an outer layer may be formed predominately of a second type of polyethylene having a relatively higher melting temperature.

In one embodiment, the substrate according to the present invention comprises a multilayer film. A multilayer film may have layers of polymer compositions particularly chosen for the characteristics they impart to the film. For example, one or two outer skin layers may be formed of compositions chosen for, e.g., surface gloss; printability; smooth feel; pliability; low noise generation (upon being handled and manipulated, as by a consumer); relatively lower melt temperature for sealing/weldability; or any combination of these characteristics. One or more intermediate layers may be formed of compositions chosen for, e.g., tensile strength; stiffness; toughness; decorative appearances; suitability for inclusion of blended-in recycled material; environmentally-friendly and/or sustainable material sourceability; relatively higher melt temperature; co-extrusion compatibility with adjacent layers (such that strong bonding between layers occurs upon co-extrusion); or any combination of these characteristics.

The substrate of the present invention may further comprise an additional layer such as a paper layer, a metal layer and a metallization layer. A paper layer herein intends to include a paper layer made from natural fibers, synthetic fibers or any combination thereof. A metal layer herein tends to include foils such as made from aluminum, copper and other suitable metals or alloys. A metallization layer herein intends to include a polymeric film with a thin layer of metals or oxidization of metals via suitable metallization processes, such as vacuum metallization or spattering metallization, etc.

A polymeric film layer forming or comprised by the substrate according to the present invention can be pigmented. The polymeric film layer can be clear or opaque.

Package

A package of the present invention comprises a substrate forming a plurality of panels which define an interior compartment where one or more articles are disposed. The package of the present invention has a longitudinal direction extending from the first side panel (or the first side edge) to the second side panel (or the second side edge), and a transversal direction perpendicular to the longitudinal direction, and comprises an opening feature.

In one embodiment, the package of the present invention is a retail package containing non-fragile, compressible disposable absorbent articles. It may have a hexahedral shape with a top panel, a bottom panel, a first side panel, a second side panel, a front panel, and a back panel. Referring to FIG. 1A, in one embodiment, a package 100 comprises a top panel 50, a bottom panel 51 opposite the top panel 50, a first side panel 52 and a second side panel 53 opposite the first side panel 52, a front panel 54 and a back panel 55 opposite the front panel 54. The package 100 has a longitudinal direction L extending from the first side panel 52 to the second side panel 53, and transversal direction T perpendicular to the longitudinal direction L.

The substrate to form the package according to the present invention has a first tearing force in a first direction and a second tearing force in a second direction, the second direction being perpendicular to the first direction. The first direction may be substantially parallel to the transversal direction of the package. The first direction may be substantially parallel to the longitudinal direction of the package. The first direction may be a direction forming an acute angle with the transversal direction of the package.

Figure 1B:
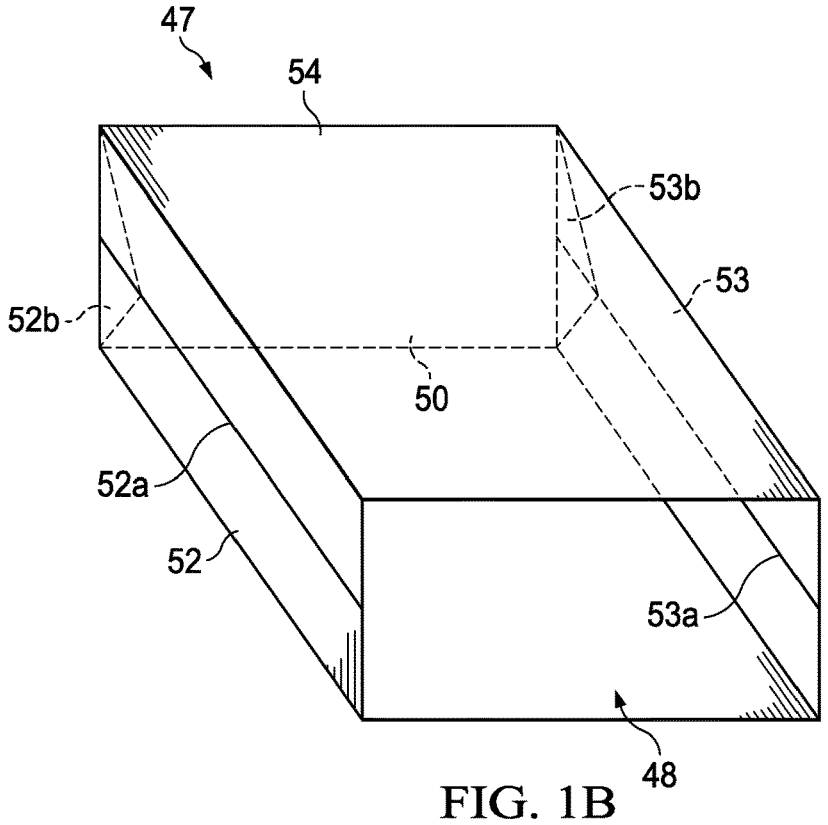
FIG. 1B is a perspective view of a flexible bag structure from which a flexible package may be formed.

Referring to FIG. 1B, a bag structure 47 may be formed from a single sheet of film stock that is suitably folded to form bag gussets 52*b*, 53*b* and then joined along portions by bonding to form two side seams 52*a*, 53*a* on opposite sides, to form bag structure 47 with no seam on a top panel 50, and open at the other end 48 (e.g., a gusseted bag structure). Thereafter, the bag structure may be filled by inserting products such as one or more rectangular cuboid shape stack of diapers through the open end 48. As may be appreciated from FIGS. 1A and 1B, the open end 48 opposite the top panel 50 may then be closed by suitably folding to form closing gussets 51*a*, bringing the film edges together, and bonding them together to form end seam 51*b* and a bottom panel 51. The bag structure 47 and the stack of products dimensions may be suitably selected and effected through design, folding, stacking, compression and packaging processes such the substrate of the package is taut about the stack to retain individual products in place within the stack, maintain stack compression, and maintain a neat, stable, approximate rectangular cuboid shape for the stack, and as a result, the package 100. Because the package 100 is formed of the flexible substrate disclosed herein, when suitably sized relative the stack dimensions, package 100 will approximately assume the approximate rectangular cuboid shape and dimensions of the stack, when the package substrate is taut, or otherwise when any loose substrate is pressed against the stack. Still referring to FIG. 1A, the package 100 may have a package length PL, a package width PW, and a package height PH.

Figure 2:
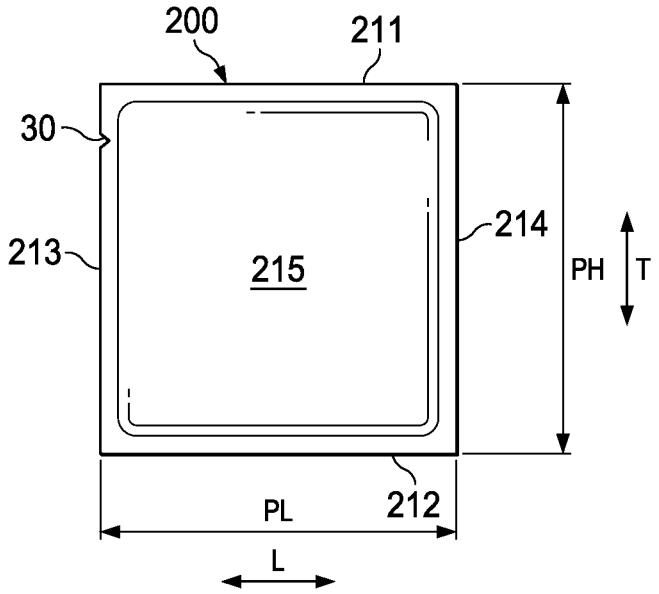
FIG. 2 is a perspective view of another flexible package.

In another embodiment, the package is a flexible sachet. Flexible sachets suitable for the present invention may be of any shape, but referring to FIG. 2, are most commonly square or rectangular. Square or rectangular sachets are generally preformed by sealing and optionally folding, along two or three edges. The remaining unsealed edge provides an open ended mouth for filling. The preform may consist of two separate polymeric films which are sealed together along three edges. Alternatively, the preform may consist of a single piece of polymeric film which is first folded, the fold forming a top edge, and then sealed along two other edges. In a further alternative embodiment, a length of polymeric film is first folded and sealed along its length to form a tube. The tube is then cut into predetermined lengths and one end of the tube is sealed to form the preform. The preform is then filled with a content to pack, and sealed. Referring to FIG. 2, the sachet 200 comprises a top edge 211, a bottom edge 212, a first side edge 213, a second side edge 214, a front panel 216 and a back panel (not shown in FIG. 2) opposite to the front panel, and comprises an opening feature, a notch 24 in this case. The sachet may have an opening feature on at least one side edge of the sachet.

The package may enclose one or more articles in a hygienically protective manner. In one embodiment, articles are typically arranged in one or more stacks inside the package. The package herein is provided with an opening flap for allowing a user to access and dispense the hygiene articles therethrough.

In one embodiment, the package is designed to provide an opening in the package by tearing a top part of package apart which provides an opening in the package and an opening flap. The opening flap can be reclosed as is, or by use of an adhesive strip which is fixedly joined to the opening flap and which is capable of releasable attachment to the package.

In another embodiment, the package is designed to provide a hood structure when the package is opened. As noted, it may be desired that the package have a recloseability feature. An opening hood structure having three sides each formed of a portion of one of the first side panel 52, second side panel 53, front panel 54 or back panel 55, and a top formed of a portion of one of the top panel 50 or bottom panel 51, as suggested in FIG. 14, can provide an effective, easy to use cover over the supply of unused product, which can help guard against entry of airborne contaminants into the package. In the example depicted in FIG. 14, a hood structure has three sides formed of portions of package panels 52, 54 and 55, and the top is formed by a portion of panel 51. The hood structure is formed when the consumer tears the package film along weakness line 302. After opening, the hood structure may be reclosed by returning it to a position similar to the one it occupied with respect to the remainder of the package, prior to opening.

Opening Feature

The package of the present invention further comprises an opening feature.

The opening feature can be various means to indicate a tear initiating point to guide users to initiate tearing the package and/or facilitate to open the package easily.

The opening feature may comprise a feature selected from the group consisting of a weakness line, an adhesive tape, an indicium, a pre-cut, a notch, and combinations thereof.

The opening feature may be located in any appropriate location (panel) in the package considering package shape, opening design and package usage, etc.

Figure 3A:
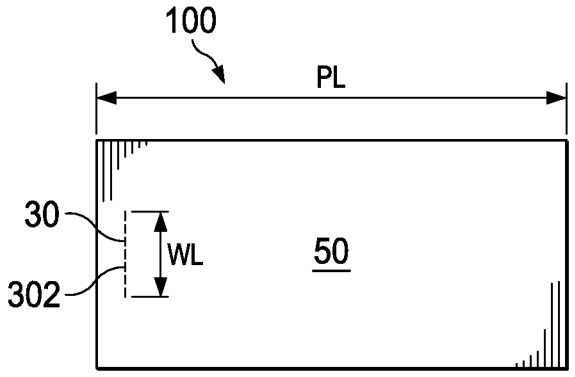
FIG. 3A is a schematic illustration of an exemplary opening feature.
Figure 3B:
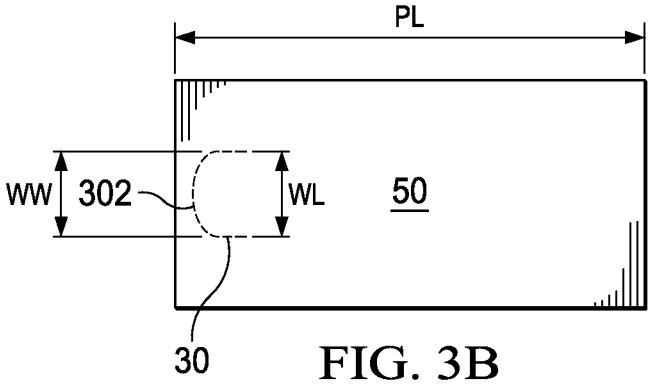
FIG. 3B is a schematic illustration of another exemplary opening feature.

The opening feature may comprise a weakness line such as a series of perforations, scoring, or a crease line for easy rapture of the package and propagate the tear. Referring to FIGS. 3A and 3B where the package has an opening feature 30 on the top panel 50, the weakness line 302 may have a weakness line length WL in a direction substantially parallel to the second direction perpendicular to the first direction, and/or a weakness line width WW in a direction substantially parallel to the first direction. The width of weakness line parallel to the second direction may determine the width of the opening. The weakness line length WL of the weakness line 302 may be longer than the weakness line width WW of the weakness line 302. In one embodiment, the weakness line width WW of the weakness line 302 is no greater than 10% of a package length PL.

The present package can be easily and reliably opened without a weakness line or a minimum length of a weakness line if it has which may minimize the chance that tensile forces exerted by the compressed flexible articles will cause premature opening the package before it reaches the end user.

Figure 4A:
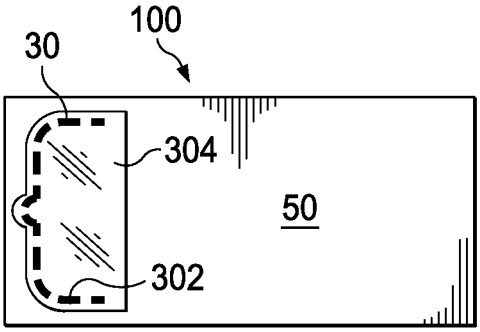
FIG. 4A is a schematic illustration of another exemplary opening feature.
Figure 4B:
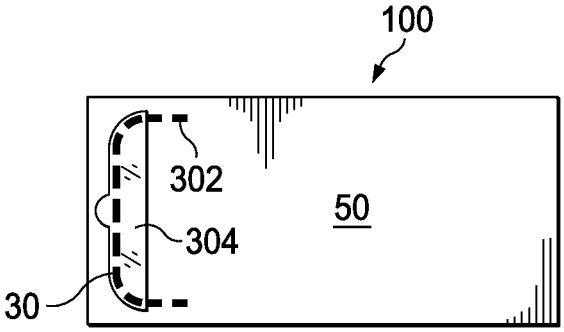
FIG. 4B is a schematic illustration of another exemplary opening feature.

The opening feature may comprise an adhesive tape. Referring to FIGS. 4A and 4B where the package has an opening feature 30 on the top panel 50, when the opening feature 30 comprises an adhesive tape 304, the adhesive tape 304 may have a portion 305 converging from a width to form a generally appeared outline leading to a tear initiating point which can be easily grasped by users' fingers. Referring to FIG. 4B, when the opening feature 30 comprise a weakness line 302 and an adhesive tape 304, the weakness line 302 may be at least partially covered by an adhesive tape 304.

The opening feature may comprise an indicium which can highlight and direct the user's attention to the location of the tear initiating point. Such indicia may include words, graphic indicia, tactilely perceivable indicia, and any combination thereof. Indicia may be provided at an appropriate position of the exterior package, in order to direct the skilled person toward proper opening of the package along the pre-determined tearing direction such as the first direction of the package. The graphic indicia may be an arrow, a line or area of color, or an imprinted path marking or tracing path of a color that visibly contrasts with surrounding package color. The graphic indicia may draw attention to the easy opening property of the package and/or demonstrates how to open the package. For example, the graphic indicia may be an image which may comprise a hand and a perspective view of the package and may demonstrate the movement of the hand relative to the package required to tear the package. The tactilely perceivable indicia may include embossing or other surface texturing of the film, configured to provide raised, tactilely perceivable features that suggest the presence of the location of the tear initiating point and/or tearing direction.

Figure 5:
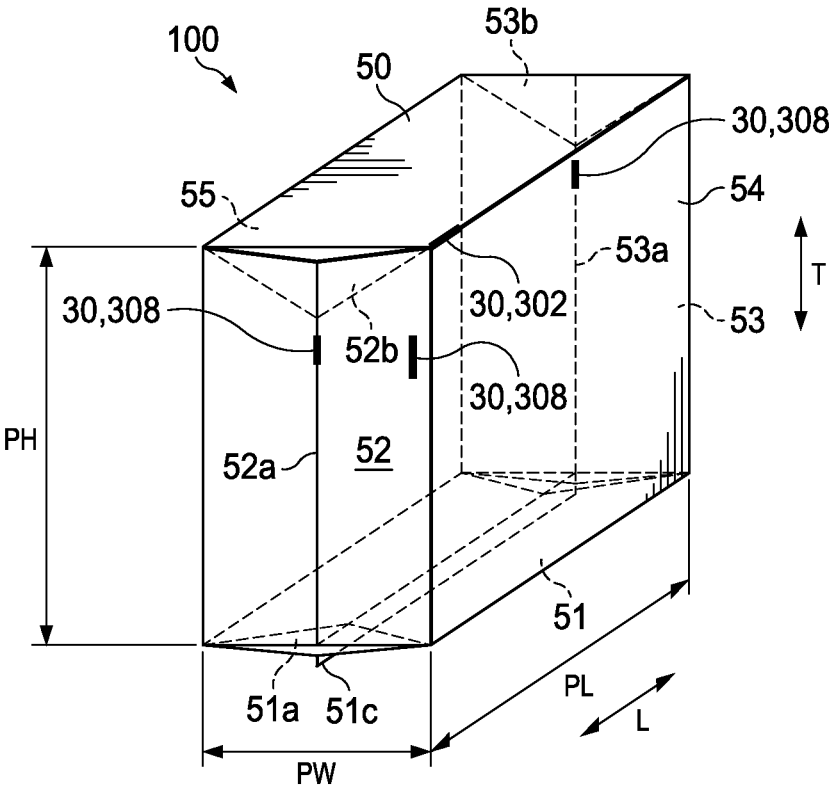
FIG. 5 is a perspective view of a flexible package depicting several possible configurations of opening feature.
Figure 13:
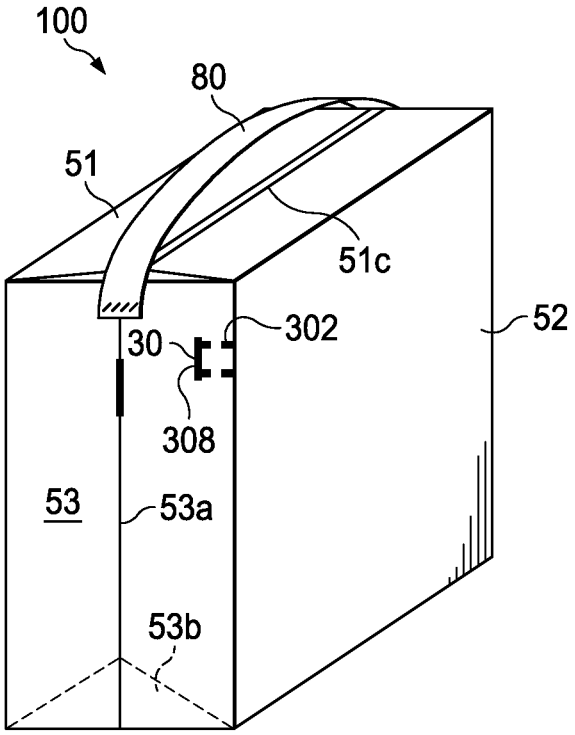
FIG. 13 is a perspective view of a flexible package depicting another possible configuration of opening feature, and having an example of a carrying handle.

Referring to FIG. 5, for example, an opening feature comprising a graphic indicum 308, a color line, may exist in a first side seam 52*a*, and/or in a second side seam 53*a*. The opening feature 30 in FIG. 5 may further comprise pre-cuts at two longitudinal ends of the graphic indium 308. The opening feature 30 may exist in the first side panel 52 and/or a second side panel 53 (not indicated in FIG. 5). Referring to FIG. 13, the opening feature 30 may comprising a graphic indicia 308 and a weakness line 302.

The opening feature may comprise a notch or a pre-cut referring to FIG. 2.

In some embodiments, an opening feature can primarily exist on a side panel (e.g., one of the left or right panels) or a side edge so that a consumer's eyes are drawn to the graphic indicia to help them to start the package opening process and indicate where the path of tearing direction is. Referring to FIG. 2, for example, the opening feature 30 comprises a notch 306 or a pre-cut which provides a starting point and indicator for the user to tear the package, the sachet 200 in this case. The notch 306 is located on a first side edge 213. Without any weakness line in any form, the tear will propagate linearly from the notch 24 into the nonsealed portion of the sachet 200 towards a second side edge 214. If desired, consumers can tear the entire top off with a linear and smooth edge of the opened bag.

In other embodiments, an opening feature can primarily exist on a top panel referring to FIGS. 3A-4B.

In other embodiments, referring to FIG. 5, an opening feature may exist in one of the top panel 50 and bottom panel 51, and at least one of the first side panel 52, second side panel 53, front panel 54 and back panel 55 to sandwich a package corner.

Figure 14:
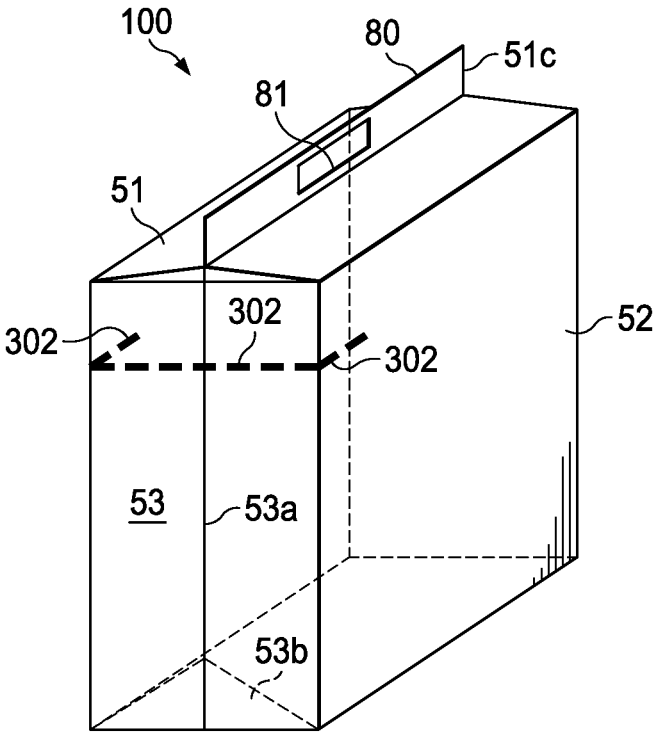
FIG. 14 is a perspective view of a flexible package depicting another possible configuration of opening feature, and having another example of a carrying handle.

Referring to FIGS. 13 and 14, particularly for a larger package 100, the package of the present invention may further comprise a carrying handle 80. In one example, a carrying handle 80 may be formed of a strip. In a more particular example, the strip may have its long dimension oriented along the first direction of the substrate forming the package. The strip may be bonded by any suitable mechanism to portions of the package or package film. In another example depicted in FIG. 14, a carrying handle 80 may be formed of an extension of a fin 51*c* extending from the package from an end seam 51. The end seam fin 51*c* may have a handle cutout 81 made therethrough, providing a carrying handle 80. The handle cutout 81 may have its long dimension oriented along the first direction of the substrate forming the package.

Measurement

1. Tearing Force Test

Tearing force in a machine direction and a cross-machine direction of a substrate is measured according to ASTM D 1922-15. When a substrate specimen is prepared from a package, the substrate is cut from the finished product using a razor blade or scissors to excise the substrate from the package not to include a seam, or a gusset or any bonding. Five replica for each sample are tested and average tearing force of the five replica is reported as tearing force.

2. Tearing Performance Test

Tearing performance of a substrate is conducted in order to test straight linearity tearing in one direction of a sample substrate.

When a substrate specimen is available in a raw material form, a rectangular test specimen with a size of 300 mm×100 mm is cut from the raw material. When a substrate specimen is prepared from a package, the substrate is cut from the finished product using a razor blade or scissors to excise the substrate specimen with a size of 300 mm×100 mm from the package without inclusion of a seam, or a gusset or any bonding area.

Figure 6A:
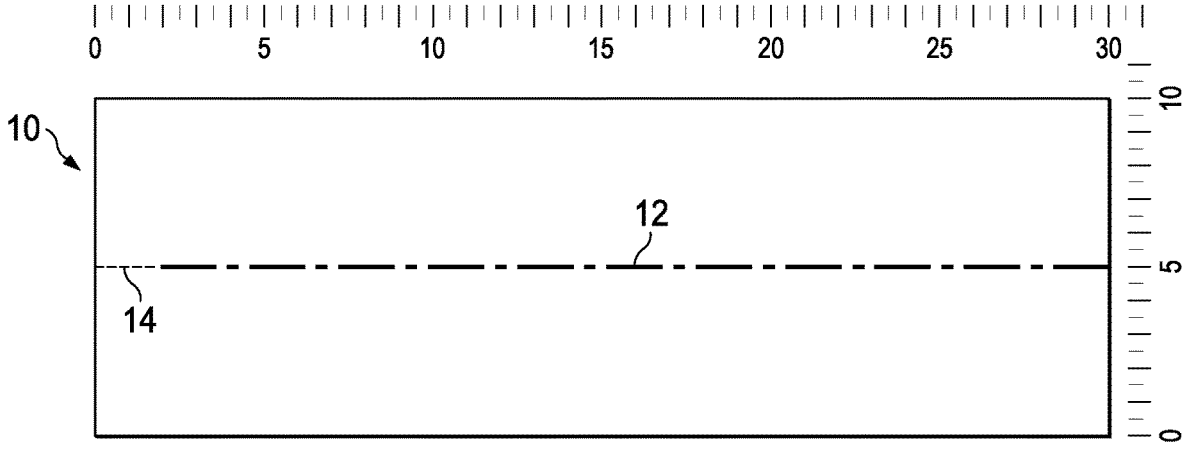
FIGS. 6A and 6B are schematic illustrations of Tearing Performance Test.
Figure 6B:
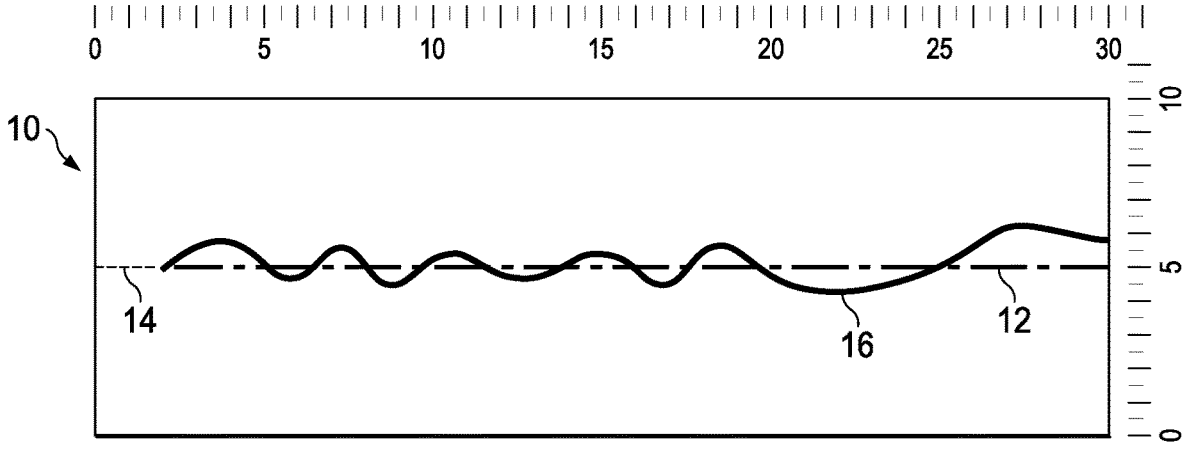

Referring to FIG. 6A, a substrate specimen 10 of 300 mm×100 mm is placed on a scale template. An imaginary center line 12 indicates a center line in a length direction of the specimen 10. A 20 mm pre-cut slit 14 is made from one side end of the specimen 10 along the center line 12. Referring to FIG. 6B, each of the two sides of the pre-cut 14 in the specimen 10 is held with fingers, and the specimen 10 is torn along the first direction. Appearance of the torn specimen after tearing is evaluated.

EXAMPLES

Example 1. Film Preparation

Film substrates were prepared as below.

Substrate 1: 30 μm mono-axial direction orientation ("MDO", hereinafter) film layer was prepared. A composite of about 65% polyethylene, about 8% of polypropylene, about 24.5% CaCO3, and about 2.5% polymethyl methacrylate (PMMA) was blended and co-extruded via traditional film blowing process to make a precursor film. The precursor film then passed through a machine direction orientation process in which the film is continuously stretched along the machine direction of the film via a set of several nipper rollers to reduce the film thickness into 30 μm.

Substrate 2: Substrate 2 was prepared by laminating Substrate 1 and a 70 μm PE film layer using a solvent free adhesive to bond the two film layers together.

Substrate 3: Substrate 3 was prepared by laminating Substrate 1 and a 30 μm PE film layer using a solvent free adhesive to bond the two film layers together.

Substrate 4: 70 μm PE film from package of in market PE film for Pampers (Procter and Gamble, China).

Substrate 5: 25 μm MDO PE film from Huangshan Novel (China).

Substrate 6: Substrate 6 was prepared by laminating a 20 μm MDO PE film layer (Huangshan Novel, China) and a 55 μm PE film layer which is blown film with a composition of HDPE, MDPE and LLDPE.

Substrate 7: Substrate 7 was prepared by laminating a 12 μm PE film layer, a 9 μm aluminum layer, a 12 μm PET film layer and a 45 μm PE film layer.

Example 2. Tearing Property of Film Substrates

Tearing forces in a machine direction and in a cross-machine direction of Substrates 1-7 were tested according to Tearing Force Test disclosed herein. All results are indicated in Table 1 below.

TABLE 1

| | Substrate 1 | Substrate 2 | Substrate 3 | Substrate 4 | Substrate 5 | Substrate 6 | Substrate 7 |
|---|---|---|---|---|---|---|---|
| MD Tearing force (gf) | 22.4 | 204.8 | 44.8 | 264.4 | 176 | 1368 | 76.8 |
| CD Tearing force (gf) | 966.4 | 310.4 | 352 | >1600* | 227.2 | 249.6 | 83.2 |
| Raito of the second tearing force to the first tearing force | 49.70 | 1.55 | 8.07 | >6 | 1.31 | 5.48 | 1.13 |

>1600*: The instrument to test tearing force has an upper measuring limit of 1600 gf. This material exceeded the upper limit Tearing performance of Substrates 1-6 were evaluated according to Tearing Performance Test disclosed herein. Images of torn substrates of Substrates 1-6 in the first direction and the second direction according to the Tearing Performance Test are shown in FIGS. 7A-12B.

Figure 7A:
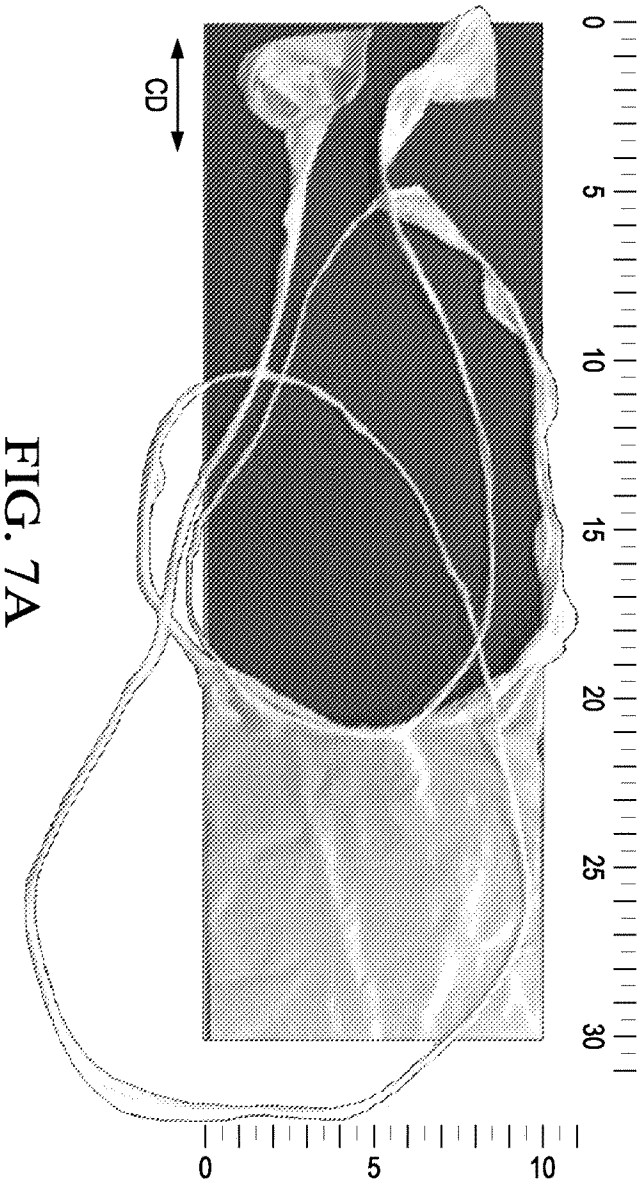
FIGS. 7A and 7B are Tearing Performance Test results of Substrate 1 in a cross-machine direction and a machine direction, respectively.
Figure 7B:
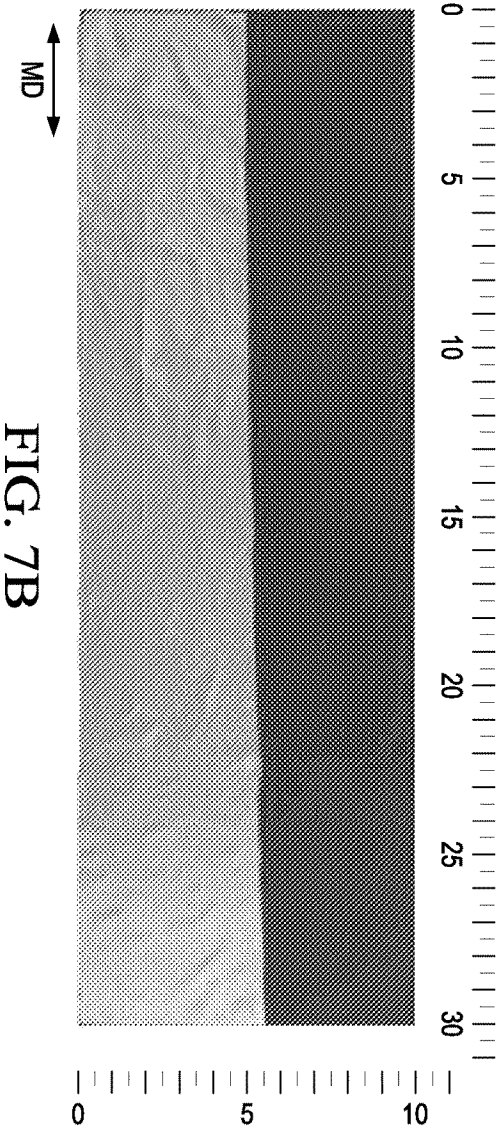
Figure 8A:
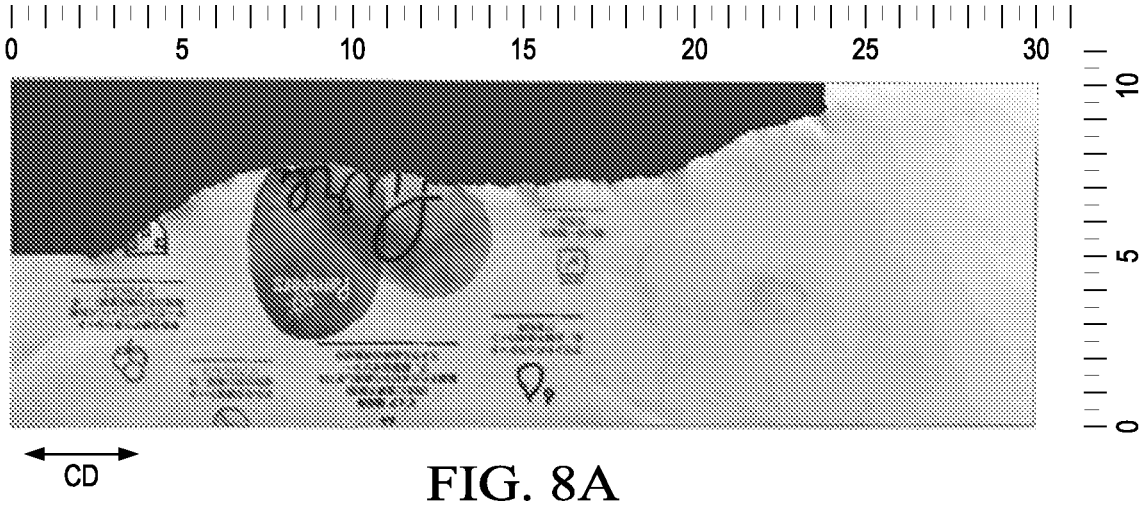
FIGS. 8A and 8B are Tearing Performance Test results of Substrate 2 in a cross-machine direction and a machine direction, respectively.
Figure 8B:
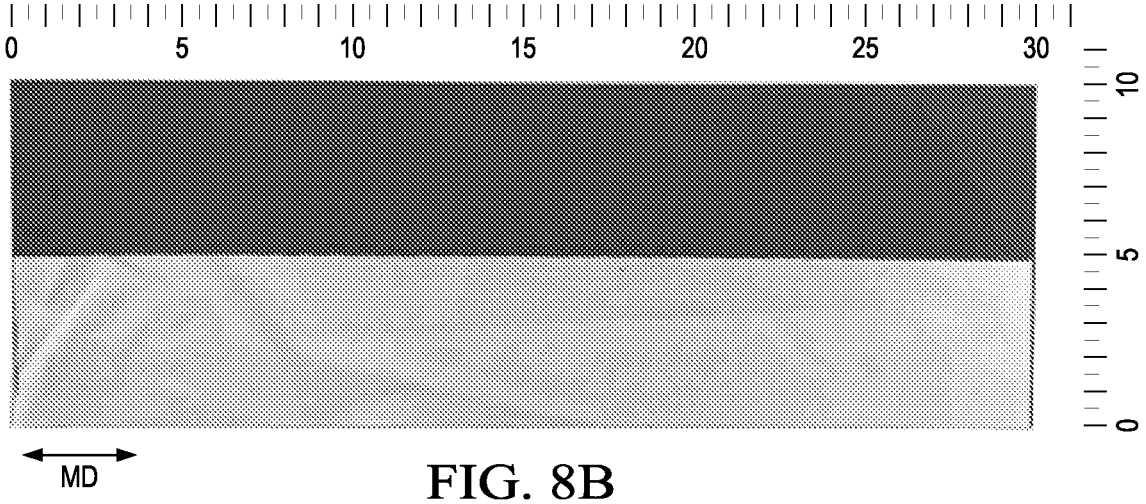
Figure 9A:
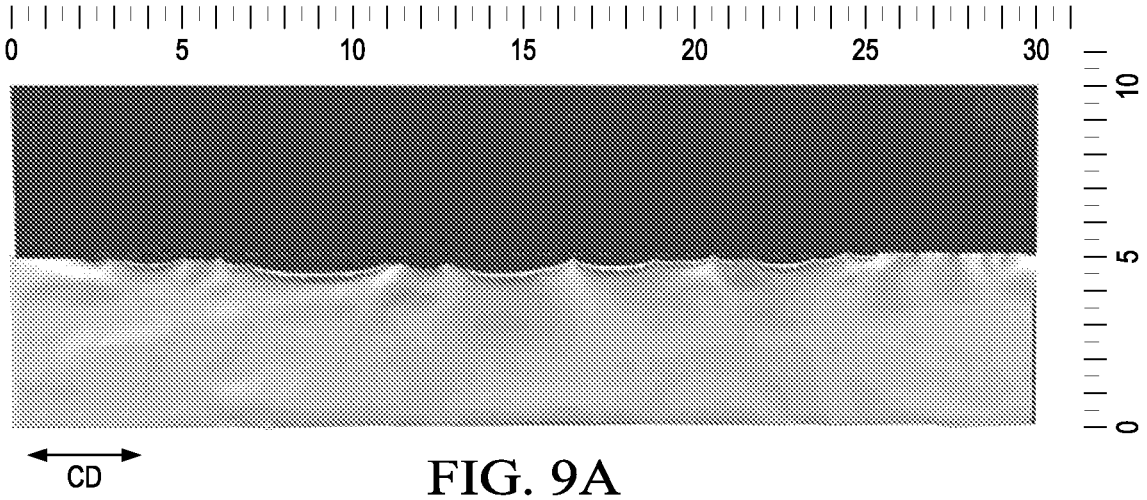
FIGS. 9A and 9B are Tearing Performance Test results of Substrate 3 in a cross-machine direction and a machine direction, respectively.
Figure 9B:
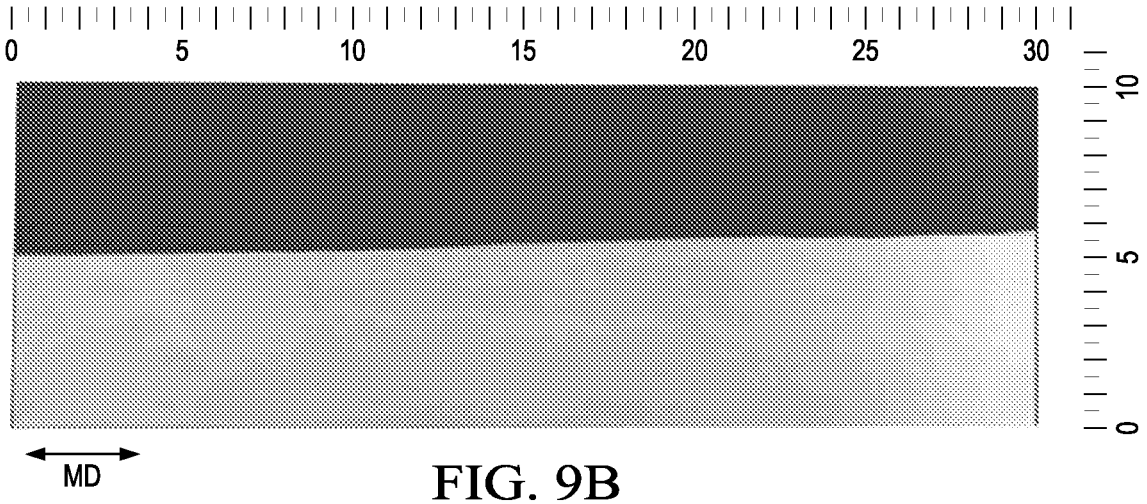
Figure 10A:
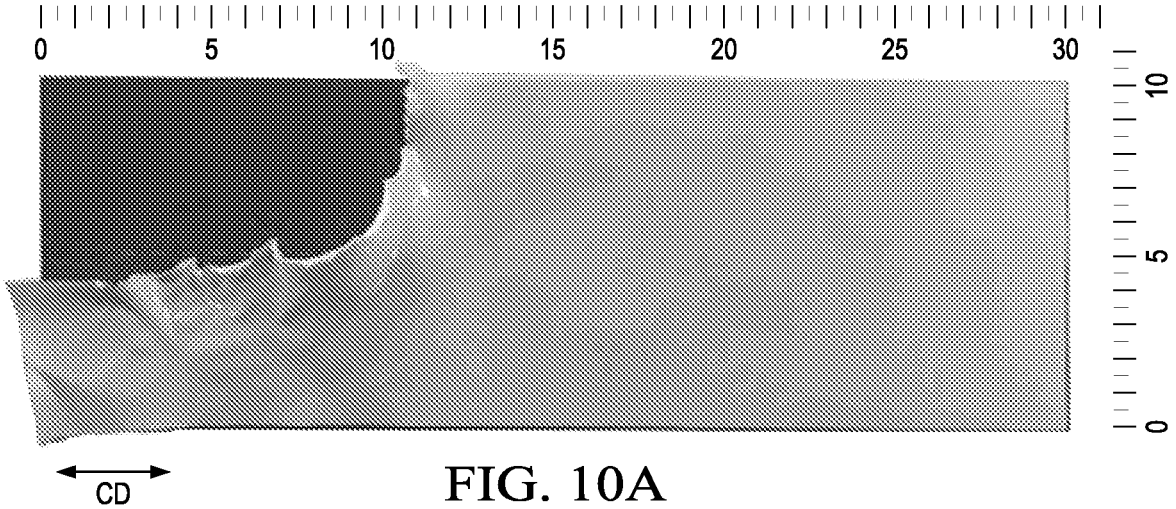
FIGS. 10A and 10B are Tearing Performance Test results of Substrate 4 in a cross-machine direction and a machine direction, respectively.
Figure 10B:
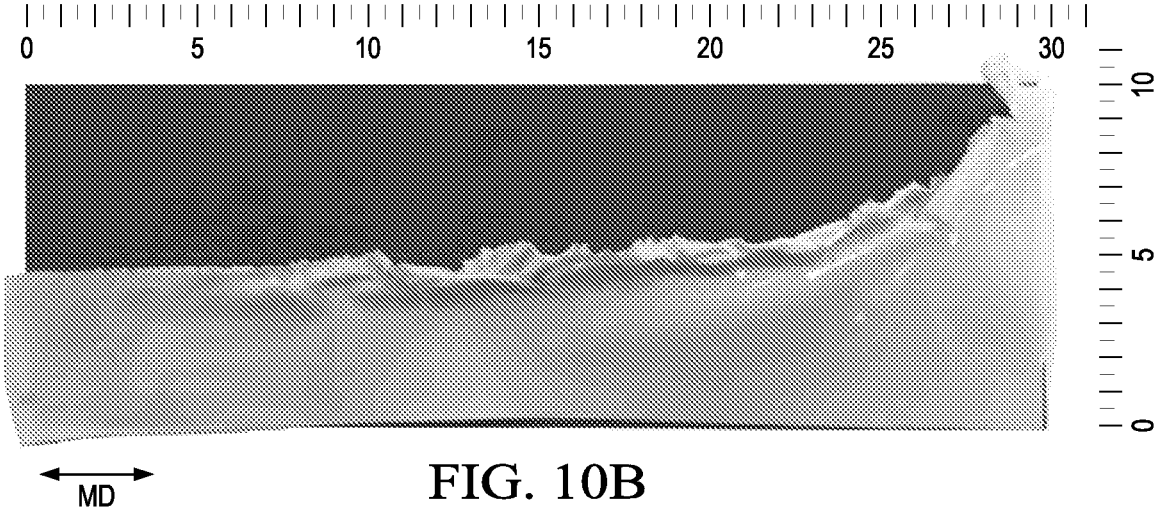
Figure 11A:
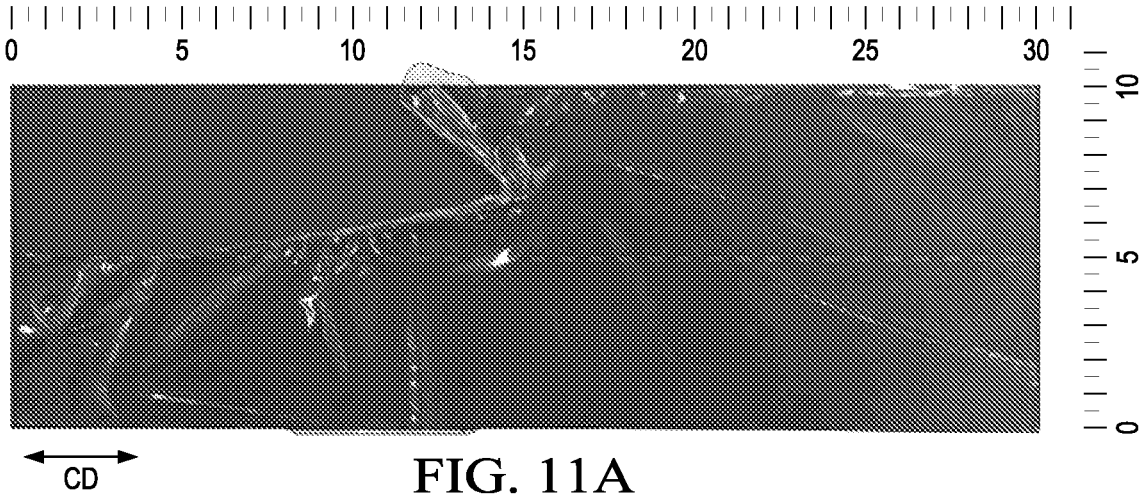
FIGS. 11A and 11B are Tearing Performance Test results of Substrate 5 in a cross-machine direction and a machine direction, respectively.
Figure 11B:
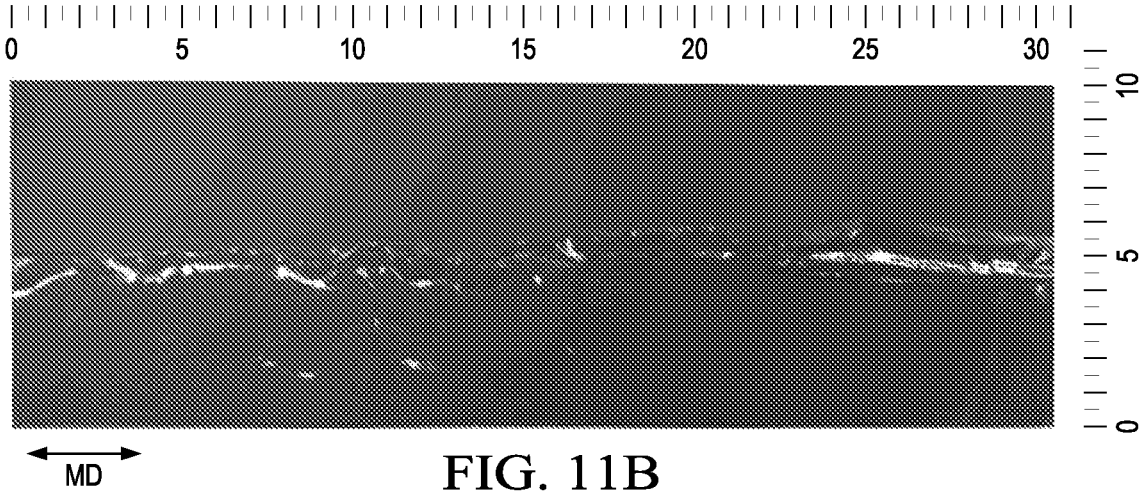
Figure 12A:
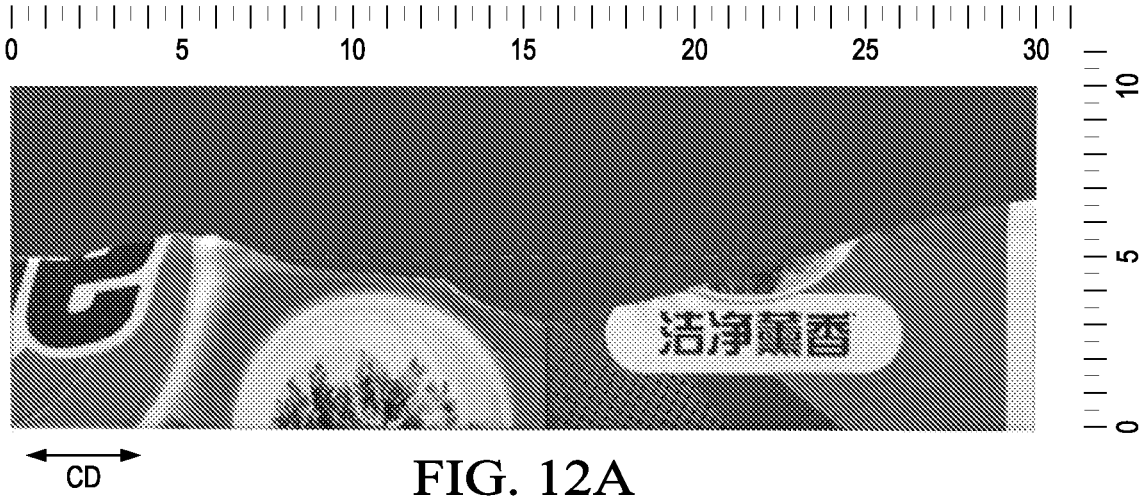
FIGS. 12A and 12B are Tearing Performance Test results of Substrate 6 in a cross-machine direction and a machine direction, respectively.
Figure 12B:
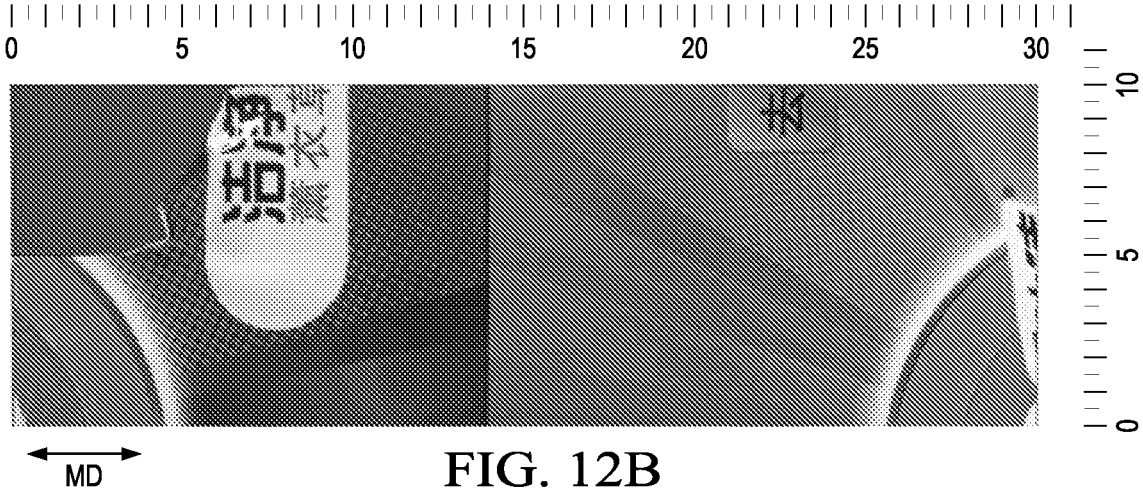

| | Substrate 1 | Substrate 2 | Substrate 3 | Substrate 4 | Substrate 5 | Substrate 6 |
|---|---|---|---|---|---|---|
| Cross-machine direction tearing | FIG. 7A | FIG. 8A | FIG. 9A | FIG. 10A | FIG. 11A | FIG. 12A |
| Machine direction tearing | FIG. 7B | FIG. 8B | FIG. 9B | FIG. 10B | FIG. 11B | FIG. 12B |

Each of Substrates 1-3 shows substantially linear and very neat tearing in the first direction, a machine direction in these cases, while Substrates 4-6 show failure of linear and neat tearing in either a machine direction or a cross-machine direction.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A package of one or more articles, the package having a longitudinal direction and a transversal direction perpendicular to the longitudinal direction, and comprising:

a substrate comprising at least one film layer, the substrate forming a plurality of panels, and an opening feature, wherein the panels define an interior compartment where the one or more articles are disposed, wherein the substrate has a first tearing force in a first direction and a second tearing force in a second direction, the second direction being perpendicular to the first direction, wherein the first tearing force is no greater than about 240 gf and no less than about 20 gf as measured according to Tearing Force Test, and wherein a ratio of the second tearing force to the first tearing force is no less than about 1.35;

wherein the package comprises a top panel, a bottom panel opposite the top panel, a first side panel, a second side panel opposite the first side panel, a front panel, and a back panel opposite the front panel, wherein the longitudinal direction extends from the first side panel to the second side panel; and wherein the first direction is a direction forming an acute angle with a machine direction.

2. The package of claim 1, wherein the film layer is a multilayer film.

3. The package of claim 1, wherein the substrate further comprises at least one metal layer or one metallization layer.

4. The package of claim 1, wherein the opening feature comprises a feature selected from the group consisting of a weakness line, an adhesive tape, an indicium, a pre-cut, a notch, and combinations thereof.

5. The package of claim 1, wherein the opening feature comprises a weakness line comprising a series of perforations.

6. The package of claim 5, wherein at least part of the weakness line is at least partially covered by an adhesive tape.

7. The package of claim 5, wherein the weakness line has a length extending along the second direction.

8. The package of claim 5, wherein the weakness line comprises a weakness line width extending along the first direction, and a weakness line length extending along the second direction, wherein the weakness line length is longer than the weakness line width.

9. The package of claim 1, wherein the first direction is substantially parallel to the longitudinal direction.

10. The package of claim 1, wherein the first direction is substantially parallel to the transversal direction.

11. The package of claim 1, wherein the opening feature is located in the top panel.

12. The package of claim 1, wherein the opening feature is disposed in at least one of the first side panel or the second side panel.

13. The package of claim 1, wherein the package is a sachet, the sachet comprising a top edge, a bottom edge opposite to the top edge, a first side edge, a second side edge, a front panel and a back panel opposite to the front panel, wherein the longitudinal direction extends from the first side edge to the second side edge.

14. The package of claim 13, wherein the opening feature is located in any of the first and second side edges.

15. The package of claim 1, wherein the substrate is a polymeric film substrate.

16. The package of claim 1, wherein the first tearing force is no greater than about 150 gf as measured according to Tearing Force Test.

17. The package of claim 1, wherein the film comprises an inner layer comprising a first type of polyethylene having a relatively lower melting temperature, and an outer layer comprising a second type of polyethylene having a relatively higher melting temperature.

18. The package of claim 1, wherein the film comprises a multilayer film wherein one of the film layers is paper.

19. A package of one or more articles, the package having a longitudinal direction and a transversal direction perpendicular to the longitudinal direction, and comprising:

a substrate comprising at least one film layer, the substrate forming a plurality of panels, and an opening feature, wherein the panels define an interior compartment where the one or more articles are disposed, wherein the substrate has a first tearing force in a first direction and a second tearing force in a second direction, the second direction being perpendicular to the first direction, wherein the first tearing force is no greater than about 240 gf and no less than about 20 gf as measured according to Tearing Force Test, and wherein a ratio of the second tearing force to the first tearing force is no less than about 1.35;

wherein the package comprises a top panel, a bottom panel opposite the top panel, a first side panel, a second side panel opposite the first side panel, a front panel, and a back panel opposite the front panel, wherein the longitudinal direction extends from the first side panel to the second side panel;

wherein the package comprises a hood structure when the package is opened, the hood structure comprising three sides each formed of a portion of one of the first side panel, second side panel, front panel or back panel, and a top formed of a portion of one of the top panel or bottom panel, wherein the hood structure is formed when the consumer tears the package film along a weakness line;

wherein the articles are disposable absorbent articles.

* * * * *